United States Patent [19]

Dola et al.

[11] 4,094,566

[45] June 13, 1978

[54] CONNECTOR HAVING WIRE LOCATING MEANS

[75] Inventors: Frank Peter Dola, Port Richey; Frederick William Rossler, Jr., New Port Richey, both of Fla.

[73] Assignee: AMP Incorporated, Harrisburg, Pa.

[21] Appl. No.: 770,127

[22] Filed: Feb. 18, 1977

[51] Int. Cl.[2] ..... H01R 3/06

[52] U.S. Cl. ..... 339/14 R

[58] Field of Search ..... 339/14

[56] References Cited

U.S. PATENT DOCUMENTS

| | | | |
|---|---|---|---|
| 3,768,067 | 10/1973 | Rault | 339/14 R X |
| 4,027,941 | 6/1977 | Narozny | 339/14 R |

*Primary Examiner*—Roy Lake
*Assistant Examiner*—DeWalden W. Jones
*Attorney, Agent, or Firm*—D. W. Phillion

[57] ABSTRACT

Multi-contact electrical connector comprises a housing and cover members. The housing has a mating end, a rearward end, and laterally facing sides which extend between the mating and rearward ends. Contact terminals are contained in the housing and arranged in parallel rows which extend across the laterally facing sides. Each terminal has a wire-receiving portion which is dimensioned to receive a wire and establish electrical contact therewith upon movement of the wire laterally of its axis and into the wire-receiving portion. An electrical commoning means extends across the sides of the housing adjacent to the rearward end thereof and also has spaced-apart wire-receiving portions for reception of ground wires in a cable. The cover members are dimensioned such that they can be assembled to the side surfaces of the housing and each cover member has wire-receiving grooves or channels therein in which the wires of the cable can be positioned prior to assembly of the cover members to the housing. When the cover members are assembled to the housing, the wires are inserted into the wire-receiving portions of the terminals and into the wire-receiving means of the commoning means. A method of positioning the wires and the cover members and assembling the cover members to the housing is also disclosed.

34 Claims, 22 Drawing Figures

90'
84'
88'
82'
83'
104'
20'
12
90
88
84
82
104
20
78
24
62
62
32'
32
26'
26
30'
30
38
22

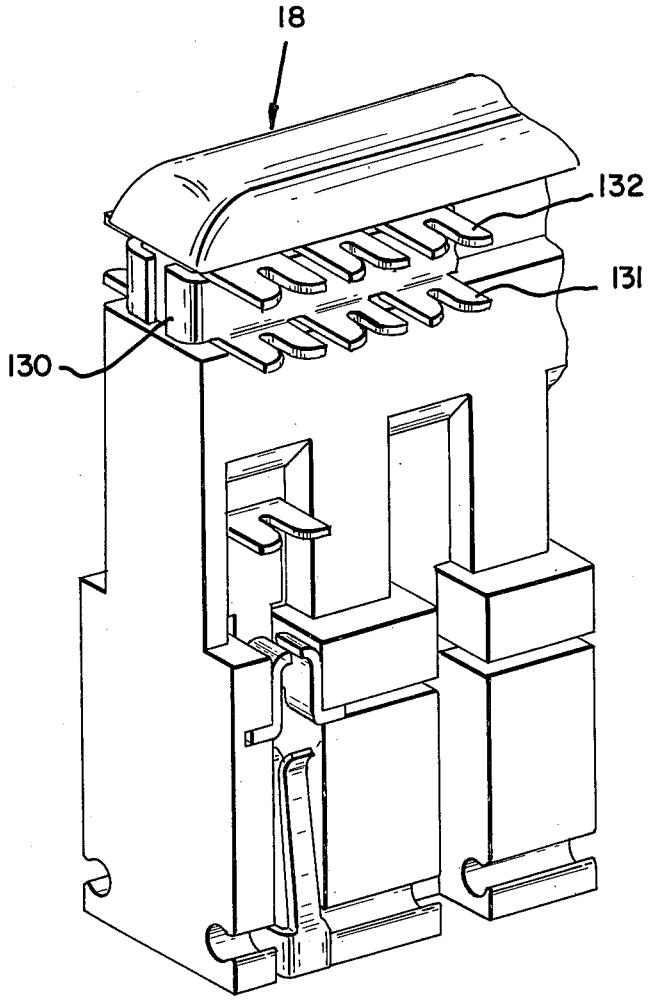
Fig. 20
Fig. 21
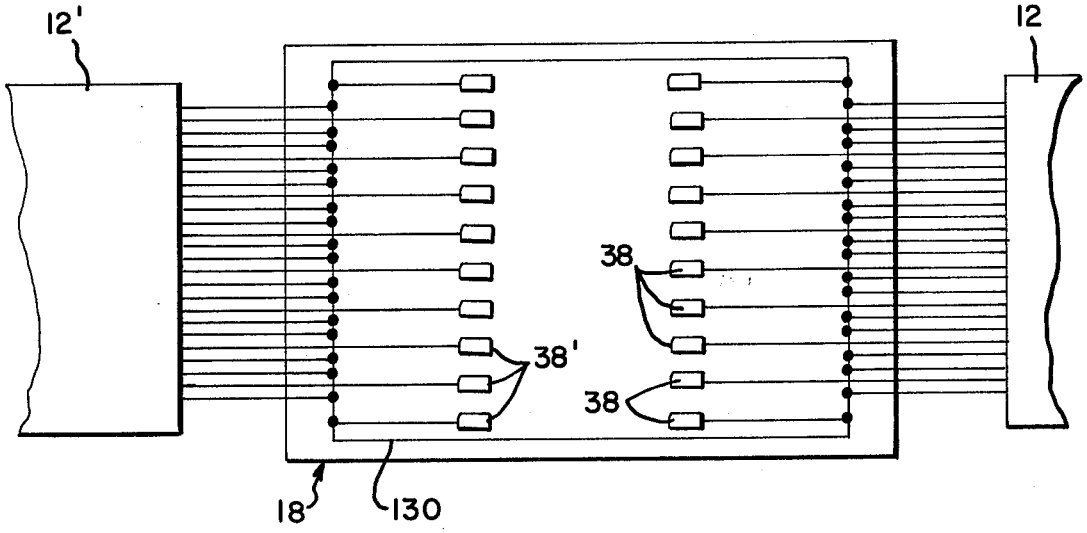

CONNECTOR HAVING WIRE LOCATING MEANS

BACKGROUND OF THE INVENTION

This invention relates to multi-contact electrical connectors of the type which are intended for installation on a flat conductor cable and which serve to connect the conductors of the cable to terminal posts of other complementary terminal devices. The embodiment of the invention disclosed herein is particularly intended for connecting the conductors of a flat cable to terminal posts on a panel board of the type used in the telephone industry and the description of the invention set forth below makes specific reference to panel boards of this type. However, it will be apparent that the principles of the invention can be used under a wide variety of circumstances and for many other applications.

It is common practice in the telephone industry to form interconnections among large numbers of conductors by means of panel boards having terminal posts extending therefrom on a grid pattern. Connections between individual posts on the panel board are made by discrete wires which have their ends connected to preselected posts. It is also necessary to connect the conductors in individual cables which extend from some remote location to the terminal posts on the panel board. It is now accepted practice to use electrical connectors for these cable-to-post connections and the connectors are designed such that the connectors can be mated with the upper free end portions of the posts and above the discrete wire connections which are provided on the lower portions of the posts adjacent to the surface of the panel board. The posts are relatively small, for example, square posts having a width of 0.025 inch are commonly used with the spacing between adjacent posts being 0.125 inch.

The cables are also quite small and have the wires on closely spaced centers of about 0.03 inch with each cable having twenty-four or more conductors therein. It will be realized that the dimensions of the cable and the spacing of the posts precludes the use of most conventional types of multi-contact electrical connectors. One specialized connector which is presently used for these cable-to-post connections comprises a housing having a small printed circuit board, usually referred to as a paddleboard, integral therewith. The conductors on the printed circuit board extend to the terminals in the connector and the conductors in the cable are connected to the conductors on the paddleboard by soldering. This system achieves the dimensional and performance requirements of cable-to-terminal post connections but it is relatively expensive and the installation of a paddleboard connector on the end of a cable is a time-consuming and tedious procedure. Furthermore, different types of cables (as regards total number of conductors and the number of signal and ground conductors in the cable) are used and many different wiring patterns of the conductors of the cable and the terminal posts are required. Paddleboard connectors can be designed to accommodate these various requirements but again, the installation costs are relatively high and the system is not amenable to the high production rates which would be desirable.

In accordance with the principles of the instant invention, a connector housing is provided which has one or two rows of electrical contact terminals therein and each terminal has a wire-receiving portion which receives, and establishes electrical contact with, a wire upon movement of the wire laterally of its axis and into the wire-receiving portion. A commoning strap or commoning band is also provided on the housing which also has wire-receiving members thereon, the arrangement being such that selected wires can be connected to the commoning band only, to one of the terminals only, and to both the commoning band and to one of the terminals. A wide variety of options are available as regards the number of signal conductors which are connected to the contact terminals, the number of ground conductors which are connected to the commoning strap or band, and the number of ground conductors which are connected to both the commoning band and one of the terminals.

The connector assembly comprises further a housing cover means which is dimensioned to be assembled to the housing and adjacent to the contact terminals and the commoning band. This cover means has wire-receiving channels thereon so that the wires in a cable can be positioned in the wire-receiving channels prior to assembly of the cover member to the housing. When the cover means is assembled to the housing, the wires, both signal conductors and ground conductors, are inserted into the wire-receiving portions of the terminals and into the wire-receiving members on the commoning band in accordance with a predetermined wiring scheme. The procedure for locating the wires in the cover members may be carried out manually or may be carried out by automatic or semi-automatic assembly machinery.

It is accordingly an object of the invention to provide an improved multi-contact electrical connector. A further object is to provide an improved method of connecting the conductors of a cable to the terminals of a multi-contact connector. A further object is to provide an improved connector for use with cables of the type which have a plurality of signal conductors and one or more ground conductors associated with each signal conductor. A further object is to provide an electrical connector assembly which can be used for a wide variety of wiring arrangements which involve the formation of electrical connections between the conductors of a flat conductor cable and terminal posts which extend from a panelboard.

These and other objects of the invention are achieved in preferred embodiments thereof which are briefly described in the foregoing abstract, which are described in detail below, and which are shown in the accompanying drawing in which:

FIG. 20 is a fragmentary perspective view showing a connector housing having an alternative form of grounding strap mounted thereon.

FIG. 21 is a schematic diagram illustrating the manner in which two cables of the type shown in FIG. 2 can be connected to the terminals and grounding strap of a connector which has the grounding strap of FIG. 20 thereon.

Figure 1:
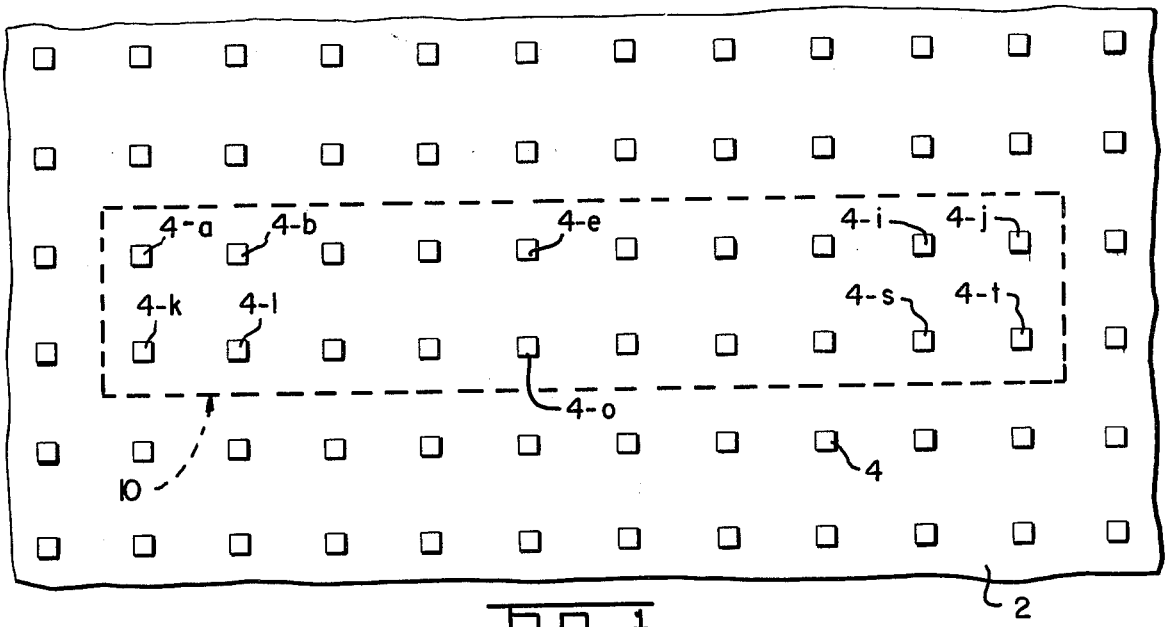
FIG. 1 is a plan view of a portion of a typical panelboard having terminal posts extending therefrom in accordance with a predetermined grid system.
Figure 3:
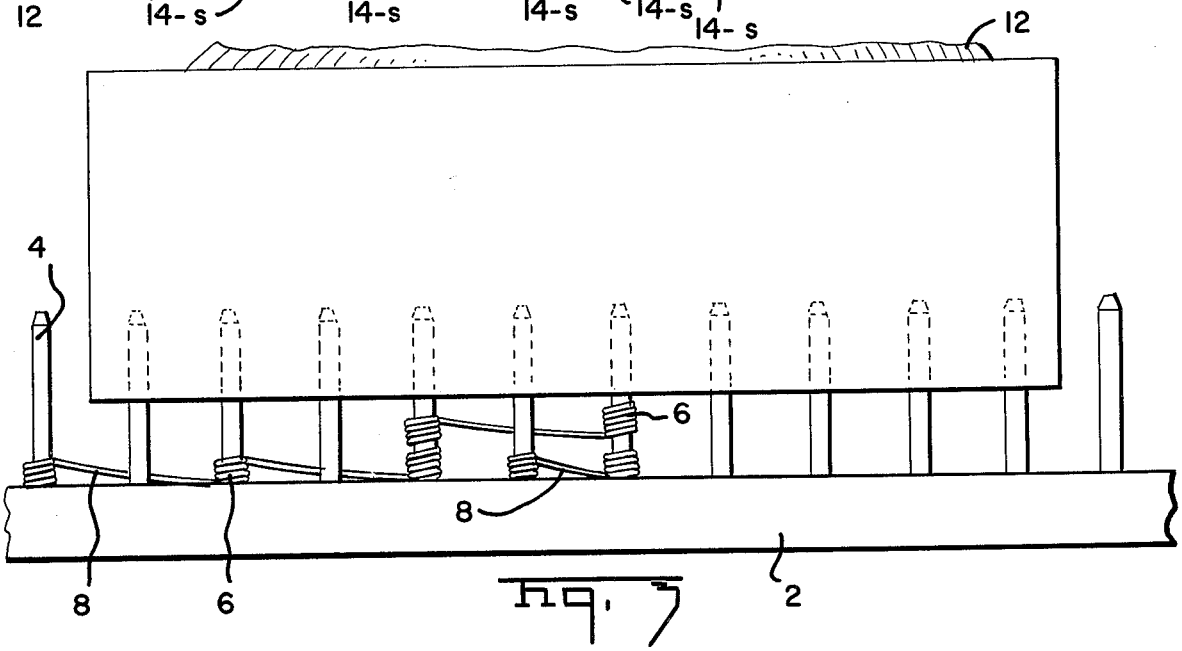
FIG. 3 is a side view of the panel of FIG. 1 showing point-to-point connections between individual terminal post and showing the manner in which a connector in accordance with the invention is mated with the upper portions of the posts.

FIG. 1 is a top plan view of a portion of a typical panelboard 2 of a type which is widely used in the telephone industry for interconnections among circuits. The panelboard has electric circuit elements such as terminal posts 4 extending therefrom in accordance with a coordinate grid system, a commonly used panelboard having 0.025 inch square posts located on 0.125 inch centers. A typical panelboard of this type may have as many as fifteen thousand terminal posts therein with the pattern shown in FIG. 1 extending for the full length and width of the board and over the entire surface thereof. Point-to-point connections between predetermined posts are made by means of wires 8, FIG. 3, which have their ends electrically connected to predetermined posts by means of wrap type connections 6.

In addition to these point-to-point connections, it is necessary to connect the conductors 14 of flat cables 12 to the terminal posts and these connections are made by connectors in accordance with the invention as described below. The cable 12 shown in FIG. 2 has a total of 24 conductors 14 but only eight of these conductors serve as signal conductors indicated at 14*s*. The remaining conductors, 14*g*, serve as ground conductors so that each signal conductor 14*s* has two ground conductors 14*g* associated therewith. As will be explained further below, the cable 12 is but one of several types of cable which are connected to the terminal posts in the panel board and the specific embodiment of the invention shown in FIGS. 4–10 is particularly intended for the cable of FIG. 2.

Referring again to FIG. 1, the terminal posts 4 on the panel board 2 are considered as arrays 10 for wiring plan purposes so that the connectors which are used to connect cables to the terminal posts 4 can be designed to be mated with a total of twenty terminal posts of a particular array. In FIG. 1 the 20 posts of the array, enclosed by broken lines, are designated between reference carriers 4*a*, 4*b*, 4*c*, - - - 4*s*, 4*t*. Depending upon the exact requirements of a particular set of circumstances, it may be necessary to connect the conductors of a cable to all of the terminal posts in a given array or to only some of those posts. The connector shown in FIG. 4, for example, serves to connect the eight signal conductors 14*s* of the cable to the terminal posts 4*b*–4*i* and to connect the ground conductors 14*g* to a commoning member in the connector. The commoning member is, in turn, connected to each of the terminal posts 4*l*–4*s*.

A further requirement of connectors for use on the panel board 2 which is assumed in the following specification is that the dimensions of the connector must be such that it is physically possible to engage a connector with every array 10 on the panel board. In other words, the external dimensions of the connector must be such that the connector does not extend beyond the broken lines shown in FIG. 2 so that a similar connector can be mated with the arrays of terminals which surround the indicated array 10 in FIG. 1.

Figure 2:
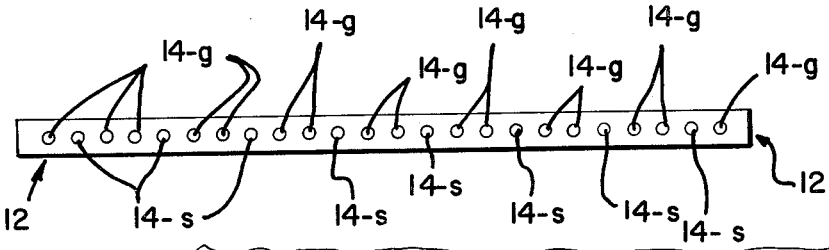
FIG. 2 is a cross-sectional view of a flat cable.

FIGS. 4–10 disclose one embodiment of the invention which is intended to connect the conductors of the cable 12, FIG. 2, to the predetermined terminals 14*b*–14*i* and 14*l*–14*s* of the array 10 as explained above. This embodiment will be described in detail and alternative embodiments intended for different cable types and wiring plans will be described subsequently.

The connector assembly 16 (FIGS. 4 and 5) comprises a generally prismatic housing 18 and a pair of cover members 20, 20′ which are assembled to the housing. The housing has a mating end 22, a rearward end 24, laterally facing relatively wide side surfaces 26, 26′ and laterally facing narrow side surfaces 28, 28′. The sides 26, 26′ are substantially identical to each other so that a description of one will suffice for both and the side 26 is described in detail below. The cover members 20, 20′ are similiar, but not identical, to each other and the cover 20′ is described below in specific detail. The same reference numerals differentiated by prime marks are used for like structural parts of the cover members 20, 20′ and the two sides 26, 26′. The differences between the two cover members will be discussed subsequently.

Figure 4:
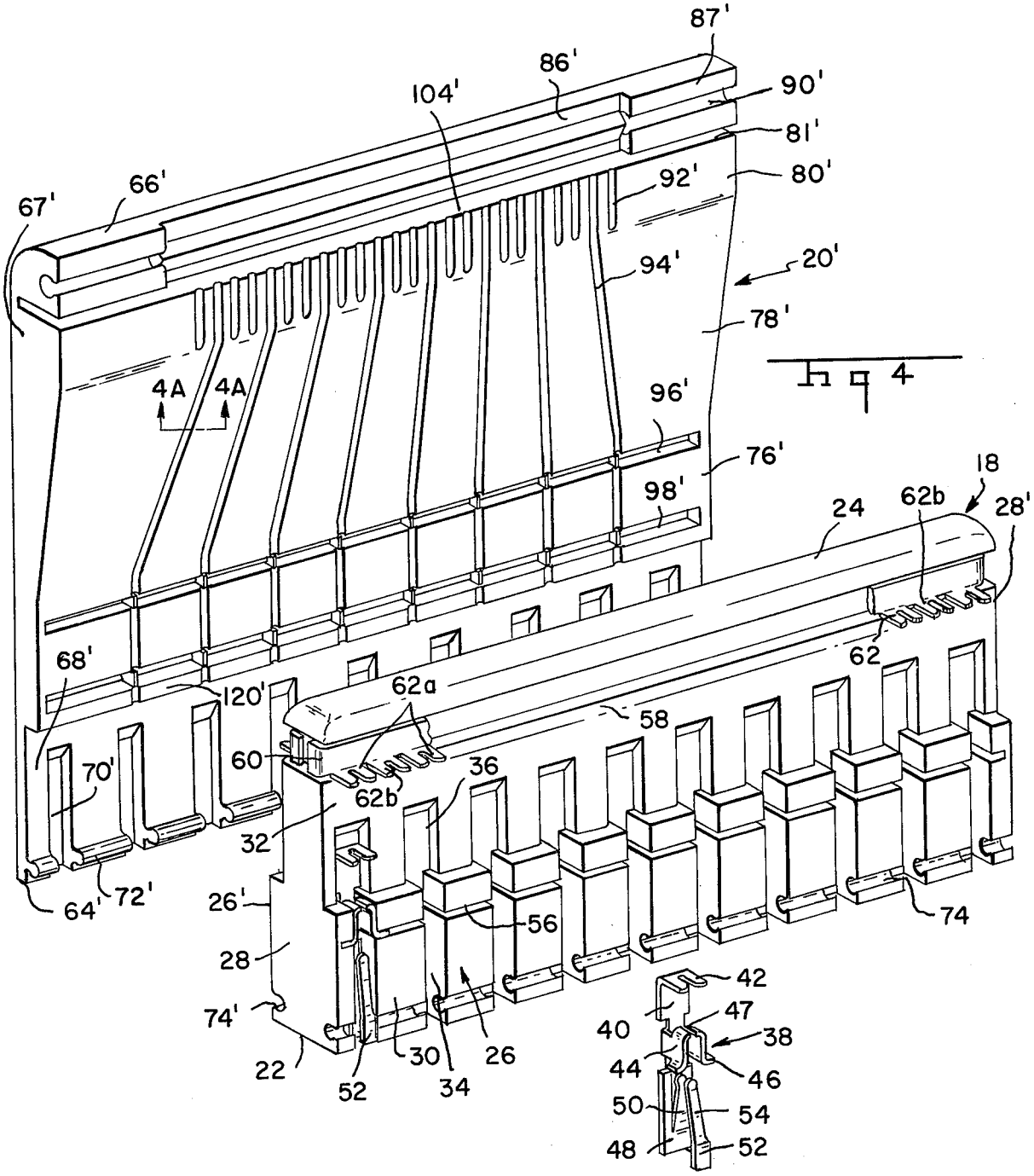
FIG. 4 is a perspective view of a connector housing in accordance with one embodiment of the invention and one of the two covers which are used with the housing.

The side 26 has a flat surface 30 which extends adjacent to the mating end 22 and a recessed surface 32 which extends adjacent to the rearward end of the housing. A plurality of contact receiving cavities 34 extend inwardly from the mating end 22 and inwardly in the surface 30. Each cavity 34 communicates with a shallow depression 36 in the surface 32. A contact terminal 38 is mounted in each cavity and extends into the aligned depression 36 as shown in FIG. 4.

Each terminal 38 has a generally flat elongated web 40 from the upper end (as viewed in the drawing) of which there extends a plate-like wire-receiving portion 42 having a wire-receiving slot extending inwardly therein from its free end. The width of this slot relative to the diameters of the wires 14 in the cable 12 is such that when a wire is moved into the slot, the edges of the slot will engage, and establish electrical contact with, the wire. A pair of retaining ears 44 extend outwardly from the web 40 intermediate the ends thereof and each ear has an outwardly formed section 46 on its end and an inwardly formed section 47 which serves as a wire stop or post stop as will be described below. The frontal portion 48 of the web has a contact spring 50 struck therefrom and an arm extends outwardly from the extreme end from this frontal portion of the web. An additional contact spring 52 extends from this arm in spaced relationship to the spring 50. The lower portion of the terminal as viewed in FIG. 4 thus constitutes a contact socket which is dimensioned to receive a terminal post 4 of the type shown in FIGS. 1 and 3. The terminals are loaded into the housing by insertion thereof into the cavities 34 so that the outwardly formed portions 46 of the ears are received in transverse slots 56 in the surface 30.

A relatively wide channel or groove 58 is provided in the housing adjacent to the rearward end 24 thereof and extends entirely around the housing and across all of the sides 32 and 28. A commoning strap or bus bar 60 is mounted in this panel and has plate-like wire-receiving members 62 extending therefrom normally of the surface 32. Alternate plate-like members indicated at **62*a* are in alignment with the wire-receiving portions 42 of the terminals 38 so that a single wire can be inserted into the slot in one of the wire-receiving members 62*a* and also into the slot of the wire-receiving portion 42 of the terminal 38 which is in alignment therewith. The remaining wire-receiving members 62*b* are located on axes which are between the axes of adjacent contact terminals 38**.

Figure 8:
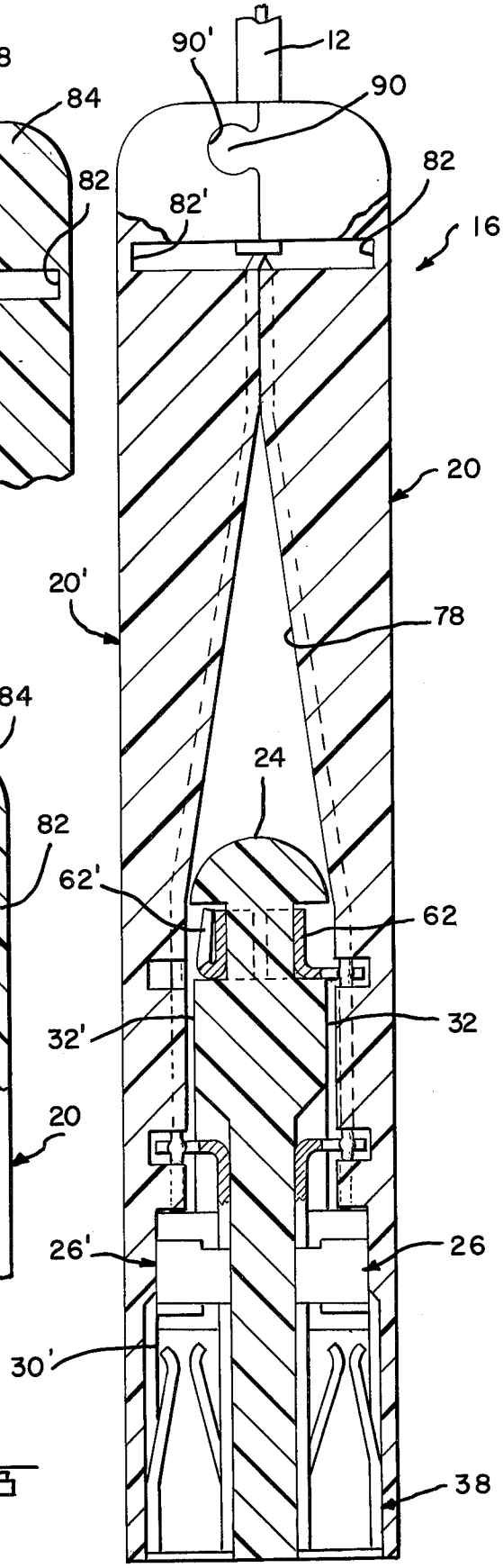
FIG. 8 is a sectional side view of the connector installed on the end of the cable.

The wire-receiving members 62 extend substantially normally of the plane of the surface 32 so that they will receive a wire which is moved towards the surface 32 as illustrated by the wire which is on the right hand side of the connector as viewed in FIG. 8. The individual wire-receiving members, however, can be bent from their functional portions towards the commoning strap 60 as illustrated by the left hand wire-receiving member in FIG. 8 so that this wire-receiving member is in a non-functional position and does not establish electrical contact with a wire which extends past its position on the commoning strap. As will be explained below, it is necessary to, under some circumstances, avoid connecting a wire to the commoning strap and the arrangement shown permits connections to be made or bypassed as desired when the connector is installed on the cable. The individual wire-receiving member 62 can, of course, be removed or rendered non-functional in some other manner if one wishes to avoid the establishment of an electrical connection between the commoning strap and a particular wire.

The cover member 20', FIG. 4, is generally rectangular and has a leading end 64', a trailing end 66', and side edges 67'. Adjacent to the leading end 64', this cover member is relatively thin and has a flat surface 68' which is dimensioned to be located against the surface 30'. Spaced-apart shallow recesses 70' are provided on the surface 68' to provide clearance for the portions of the terminals 38' which project beyond the plane of the surface 30' and cylindrical bosses 72' are provided on surface 68' adjacent to leading end 64'. These bosses are dimensioned to be received in recesses 74' in the connector housing 18 to assist in holding the cover member in assembled relationship with the housing.

An intermediate portion 76' of the surface of the cover is spaced from the surface 68' and merges with an inclined surface portion 78' which extends to a flat surface portion 80' adjacent to the trailing end 66' of the cover. It will be apparent that the thickness of the cover member increases from the leading end 64' to the trailing end 66' with the surface portion 78' serving as a transition between the relatively thinner section 76' and the rearward end of the cover. This increase in thickness between the leading and trailing ends is desirable for strength purposes, however, the profile of the cover is also important for reasons which will be discussed below in achieving the installation of the connector on a cable.

Figure 9:
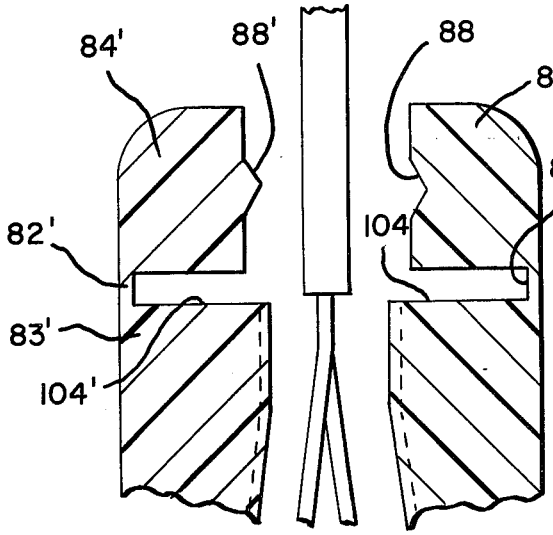
FIGS. 9 and 10 are sectional side views of the upper portions of the housing covers which illustrate a cable strain relief feature of the covers.

A transversely extending relatively deep slot 81' extends inwardly from the surface 80' so that the upper portion 84' of the cover as viewed in FIG. 9 is connected by a relatively thin web 82' to the adjacent portions indicated at 83'. This thin web 82' permits the upper portion 84' of the cover to be flexed or pivoted away from the surfaces 104' of the slot 81'. This feature is important in the installation process as will also be described below.

Figure 10:
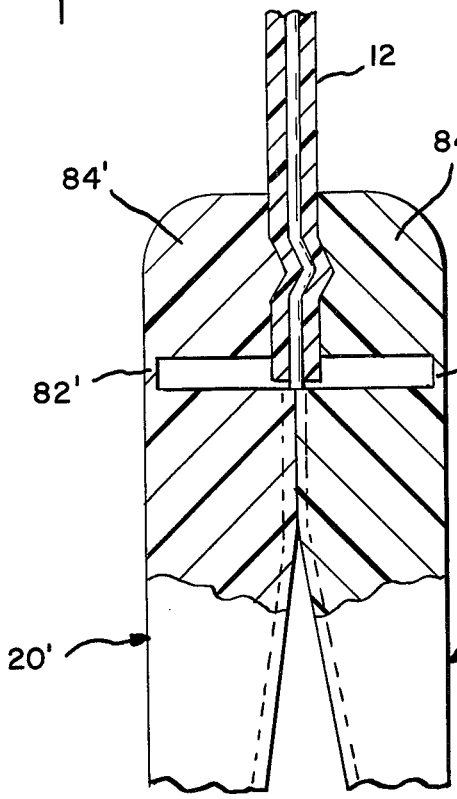

A transversely extending notch 86' is provided centrally in the surface 87' of cover 20' which is above, as viewed in FIG. 4, the deep slot 81' so that when the two cover members are against each other, the notch 86' and the notch 86 in cover member 20 provide an opening for the cable 12. It is desirable to provide a clamping means for the cable 12 and to this end, a triangular rib 88' extends centrally across the floor of notch 86' in the cover member 20'. A complementary groove 88 is provided in the surface of the cover member 20 so that when the parts are assembled to the housing and to the cable, a kink will be formed in the cable as shown in FIG. 10. This kink serves as a strain relief or cable clamp and transmits tensile forces which may be applied to the cable to the housing rather than to the conductors which extend towards the housing of the connector.

When the two covers 20, 20' are assembled to the cable 12 and to housing 18, the rearward portions 84, 84' which comprise strain relief means of the covers are secured to each other by means of complementary ribs and recesses 90, 90' on the cover parts. As previously noted, the covers are secured to the housing 18 by means for the locking bosses 72, 72' on the covers and recesses 74, 74' in the housing.

Figure 4A:
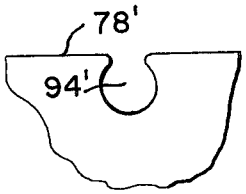
FIG. 4A is a view taken along the lines 4A—4A of FIG. 4.

Half round recesses 92' extend downwardly across the surface portion 80' from the slot 81' to the transition surface portion 78'. Selected recesses of this group communicate with wire-receiving channels 94' (FIG. 4A) which have a cross section which conforms to the wires 14 so that each channel is capable of receiving one of the wires of the cable and retaining the wire in interference fit when it is placed therein as will be described below. As shown in the drawing, these channels are generally circular and have a gap or opening which is slightly narrower than the diameter of the wires in the cable.

The wire-receiving channels 94' extend from the surface 80' across the surface 78' and then along straight line paths across the surface 76' to the end of the surface 76' as is shown in FIG. 4. The lower end of each wire-receiving channel is in alignment with one of the recesses 70' and therefore will be in alignment with one of the terminals 38' when the cover parts are assembled to the housing. It should be explained at this point that the signal conductors **14*s* of the cable shown in FIG. 2 are positioned in the channels 94' and the cover member 20' and since the cable contains only eight signal conductors, two of the terminals 38' on the side 26'** are not used in the embodiment which is being described.

Figure 5:
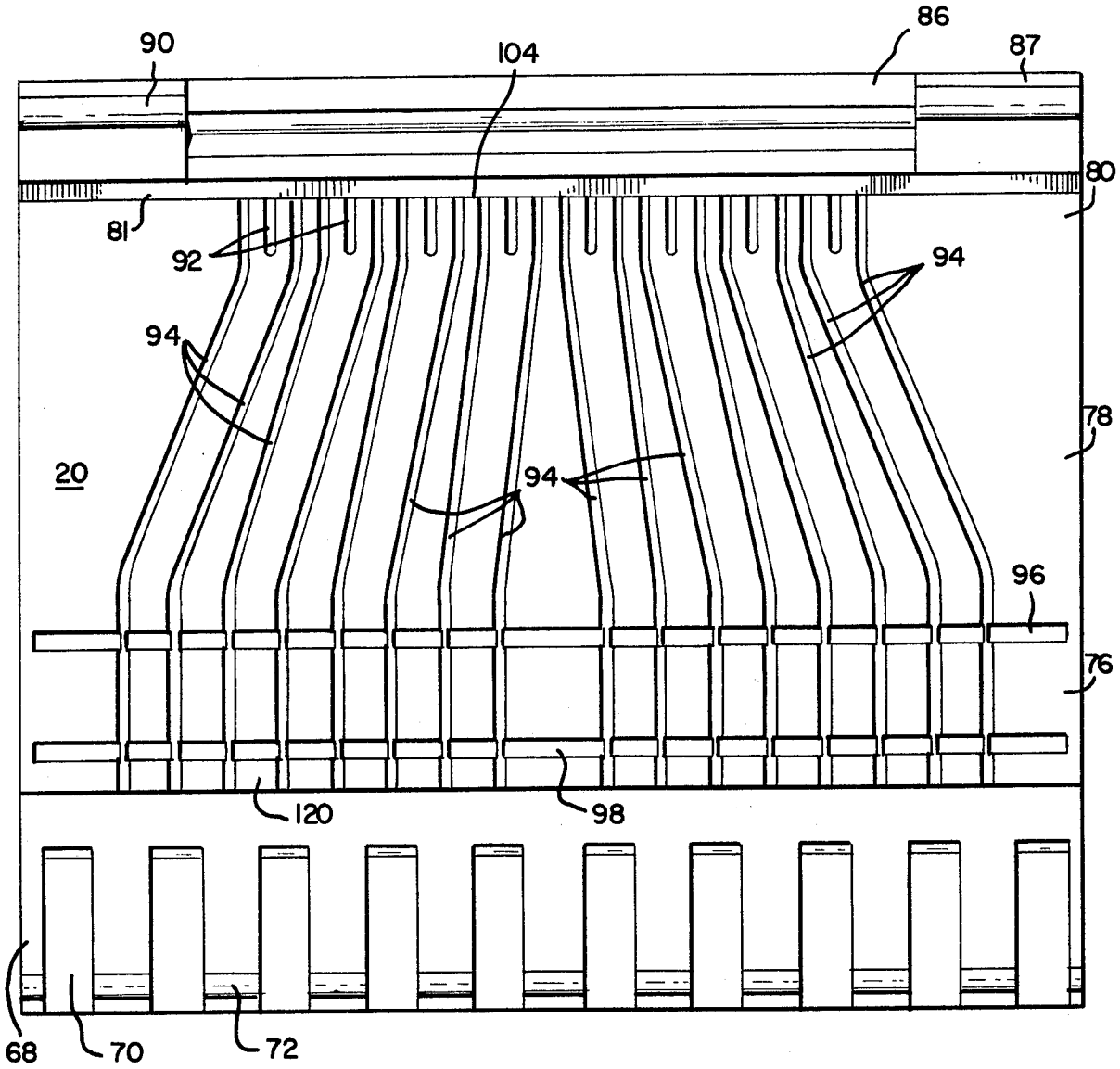
FIG. 5 is a plan view of the other cover member which is used with the housing of FIG. 4.

The cover member 20, FIG. 5, is similiar to the cover member 20' but it will be apparent from a comparison of FIGS. 4 and 5 that the wire-receiving channels 94 follow different paths and are greater in number than the corresponding channels 94'. The channels receive the ground conductors **14*g* of the cable and accordingly sixteen of these channels are provided in the cover 20**.

The cover members have transversely extending slots 96, 96' and 98, 98' in their surface portions 76, 76'. These slots provide clearance for the free outer ends of the wire-receiving portions 42 of the terminals 38, 38' and for the wire-receiving members 62, 62' of the commoning strap 60 as is shown in FIG. 8. Integral wire stuffer ribs 95, 95' are provided in the transversely extending slots 96, 96' and 98, 98' of the cover members. These stuffer ribs are in alignment with the channels 94, 94' and serve to push the wires into the wire-receiving members 62 of the commoning member 60 and into the wire-receiving portions of the terminals as will be explained below.

Figure 6:
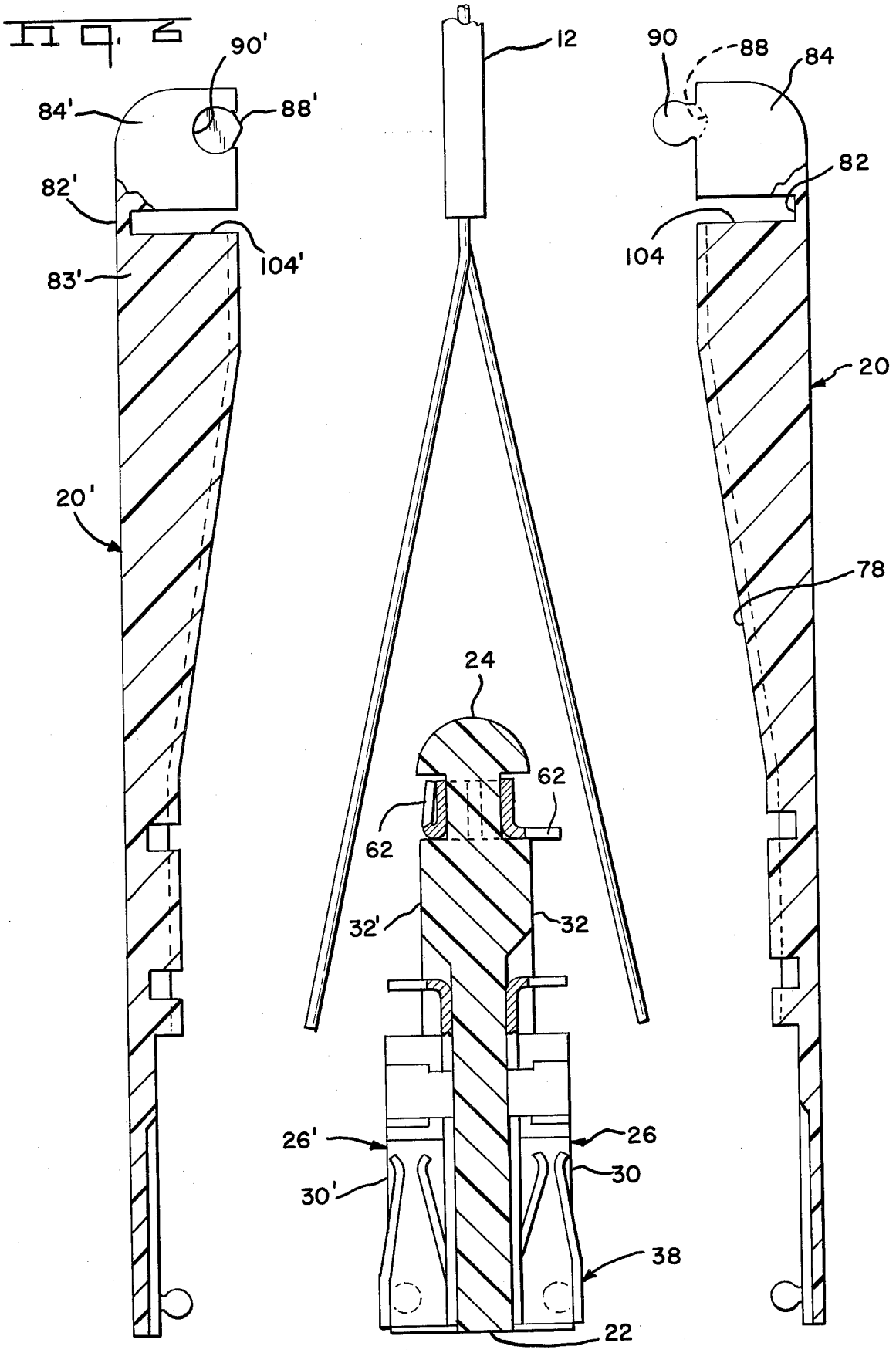
FIG. 6 is an exploded sectional side view of a connector assembly in accordance with the invention showing a cable and the conductors thereof in alignment with the terminals and the cover members of the housing.
Figure 7:
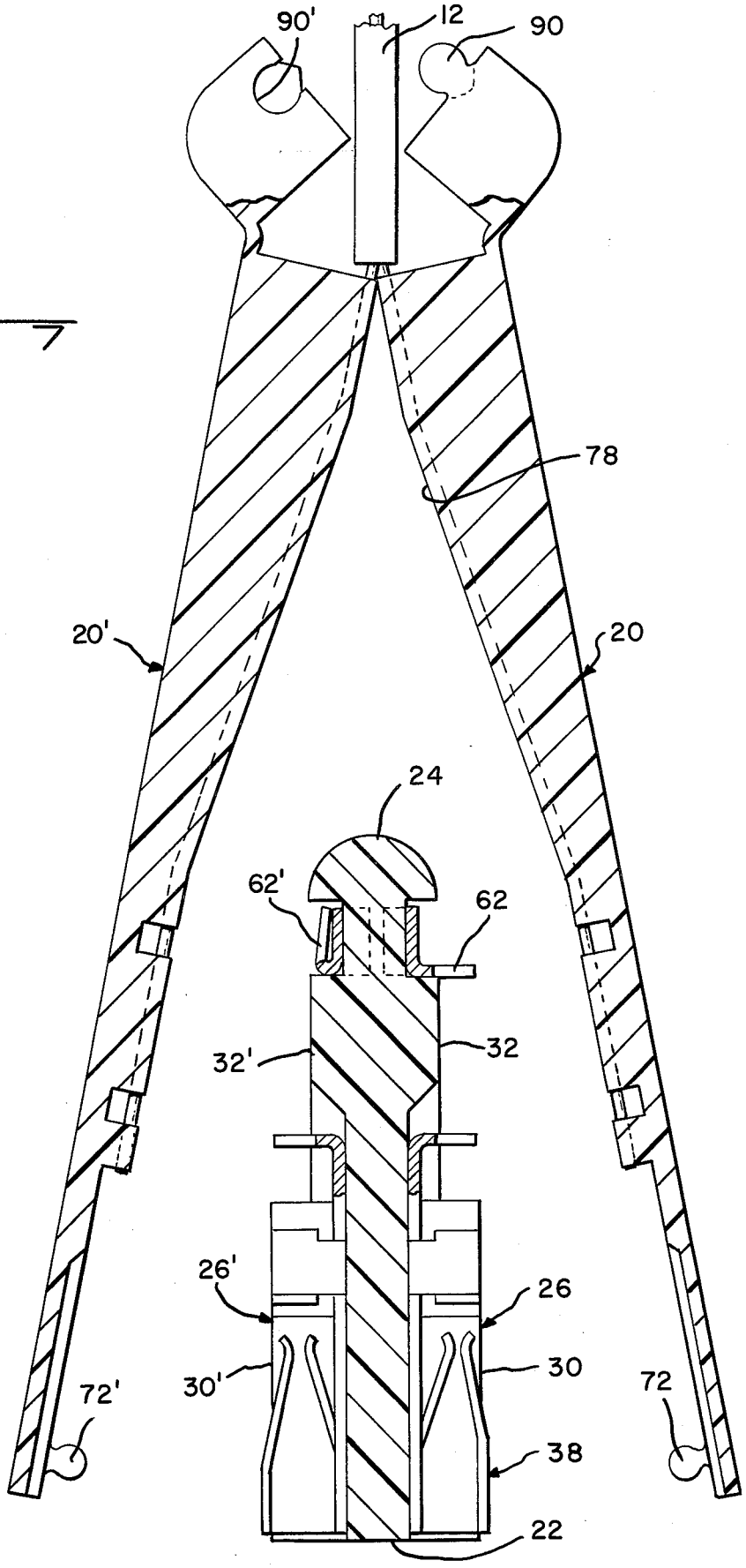
FIG. 7 is a view similiar to FIG. 6 but showing the positions of the parts at an intermediate stage during the assembly process in which the housing covers are assembled to the connector housing.

FIG. 6 is an exploded view showing the cable, the conductors in the cable, the housing, and the covers. It should be emphasized that the connector parts in the cable do not occupy the positions shown in FIG. 6 at any time during the specific process which is described below of installing the connector on the cable, this view being presented rather for purposes of clarification of the structural details of the connector. FIG. 7 is a view which shows the relationship of the cable to the cover members after the conductors have been placed in the channels 94, 94' and immediately prior to assembly of the cover members 20, 20' to the connector housing 18 while FIG. 8 shows a cross section of the assembly on the cable. It should also be emphasized that FIG. 9 is an exploded view which is provided for purposes of illustrating the functioning of the strain relief means but it does not represent the positions of the parts during assembly when assembly is carried out in the manner described below.

Figure 11:
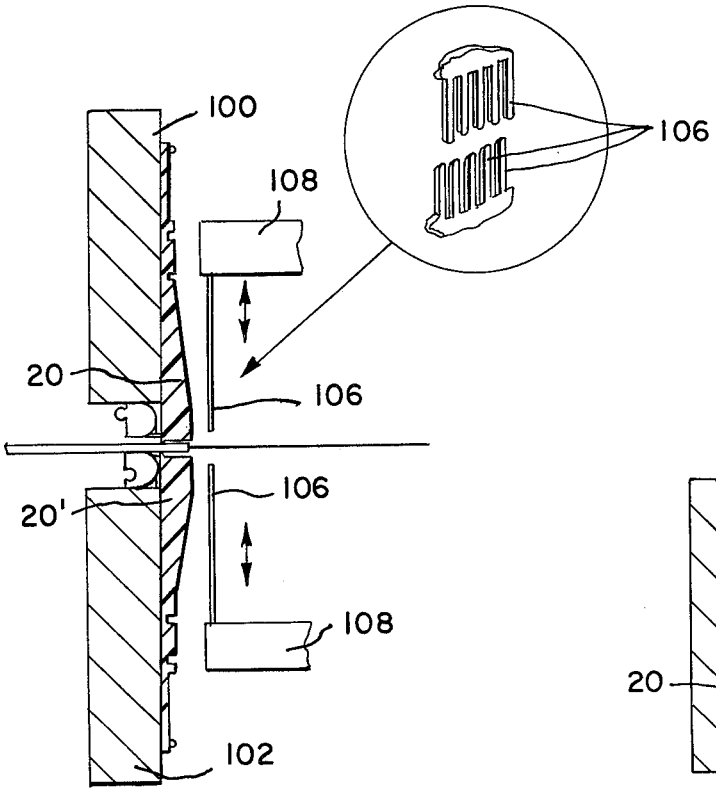
FIGS. 11–16 are a series of diagrammatic views illustrating the installation of the connector on the end of a cable.
Figure 12:
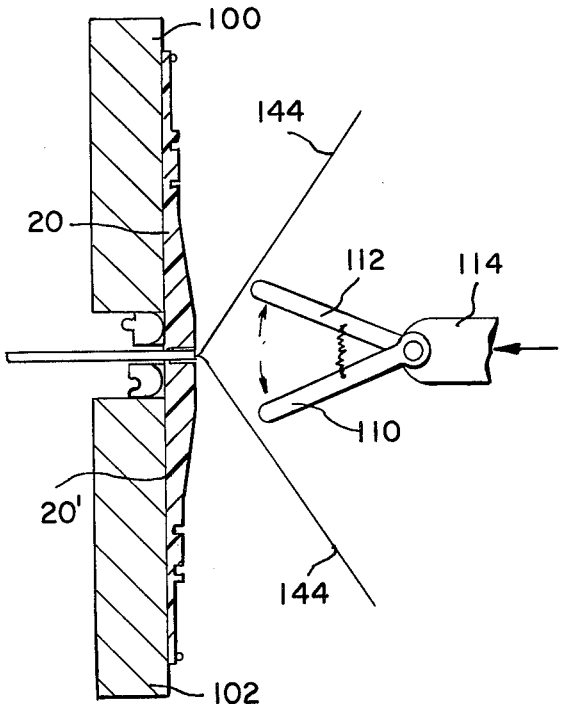
Figure 13:
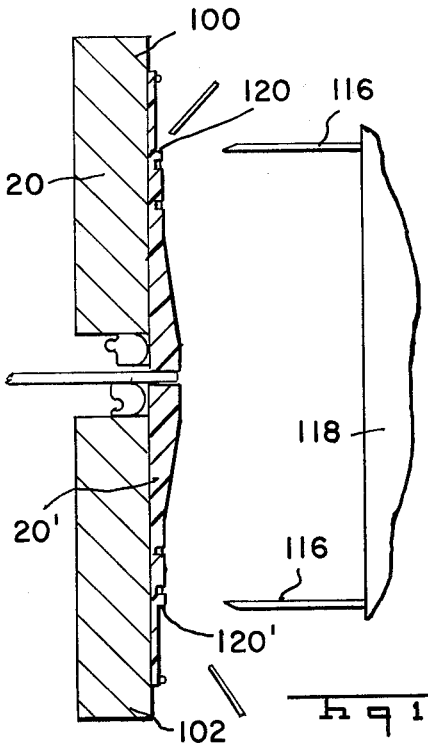

When a connector of the type shown in FIGS. 4–8 is to be installed on a cable as shown in FIG. 2, the cable 12 is first stripped so that the bare wire conductors 14 extend beyond the insulation of the cable as shown in FIG. 11. In general, the assembly process requires that the ground conductors **14*g* be placed in the wire-receiving channels 94 of the cover 20 and the signal conductors 14*s* be placed in the wire-receiving channels 94' of the cover 20'. The wires are then trimmed so that the ends of the wires extend in each cover member to the shoulders 120, 120' which separate the surfaces 68 and 76 on the cover member 20 and the surfaces 68', 76' on the cover member 20'. The cover members 20, 20'** are then assembled to the housing and during assembly, the wires are inserted into the appropriate wire-receiving members and terminals.

The assembly process described above can be carried out manually and/or with the aid of some relatively simple fixtures and hand tools. The assembly process is also amenable to the use of a semi-automatic machine as illustrated in FIGS. 11–16. These figures show the essential machine elements which would be used in installing connectors into the ends of cables. It is assumed in these views that the insulation has been stripped from the end portion of the cable as previously noted.

As shown in FIG. 11, the cover members 20, 20' are positioned on the surface of cover support members 100, 102 with the trailing ends 66, 66' of the cover members against each other and with the cover members in alignment so that the end portion of the cable 12 can be inserted through the opening defined by the opposed notches 86, 86'. During the initial stages of the process, the outer portions 84, 84' of the cover members are pivoted away from the surfaces 104, 104' as shown in FIG. 11.

The first step of the installation process is to bend all of the ground conductors **14*g* upwardly as viewed in FIG. 11 and the signal conductors 14*s* downwardly. This operation can advantageously be carried out by bending tools 108 having wire bending fingers 106 extending therefrom. When the fingers are moved towards each other from the positions of FIG. 11, they will selectively engage the ground conductors 14*g* and signal conductors 14*s* respectively and bend them to the positions shown in FIG. 12**.

The second step of the installation procedure is to spread the conductors across the rightwardly facing surfaces of the covers 20, 20' and position them in the wire-receiving channels 94, 94' which can now be seen to comprise template means. This operation is carried out with spreading or conductor deploying members 110 which are pivotally mounted on a tool holder 114 and which are biased towards each other by a spring 112. When the tool holder is moved leftwardly from the position in FIG. 12, the individual conductors will be pressed against the surfaces of the covers and will be forced into the half-round grooves 92, 92' and into the wire-receiving channels 94, 94'. By virtue of the dimensions of these channels, the wires will be retaining therein during the remainder of the assembly process.

The wires are then trimmed (FIG. 14) by moving cutting blades 116 mounted on a blade holder 118 against the surface of the covers. The blades are positioned to move past the shoulders 120, 120'.

Figure 14:
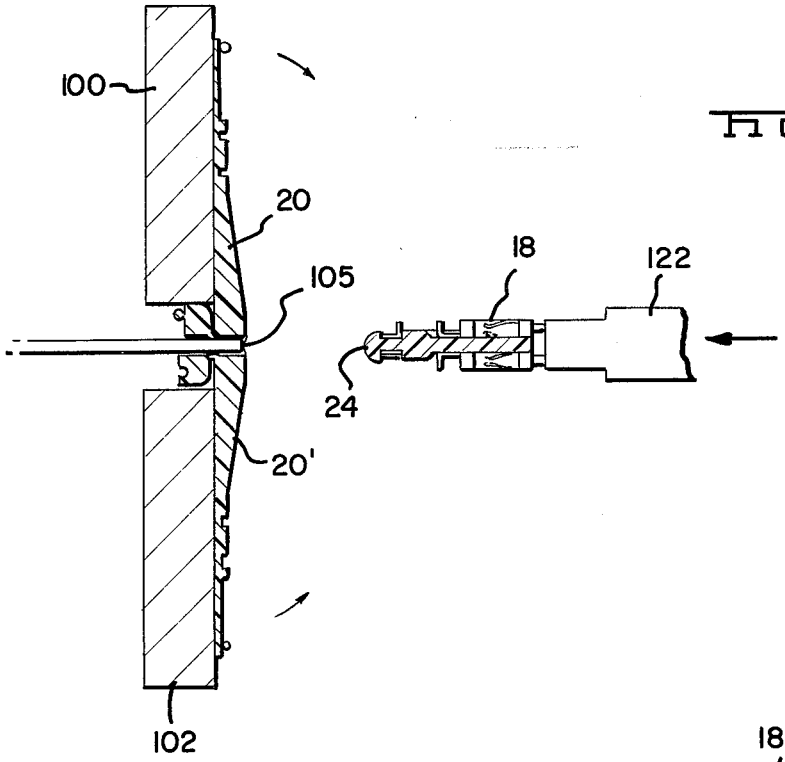
Figure 15:
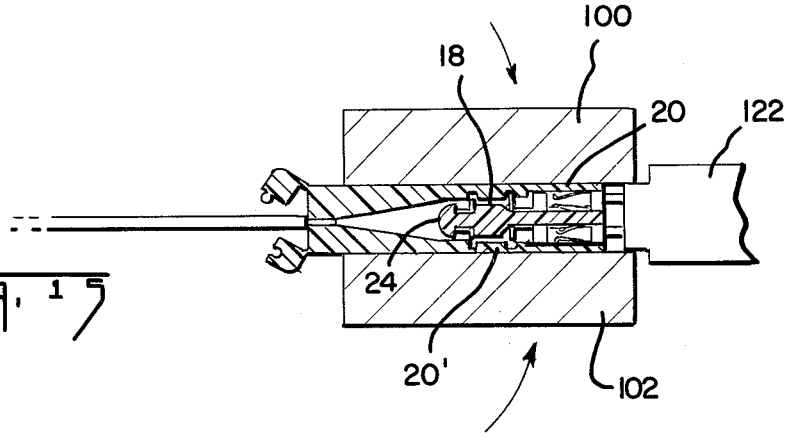

The connector housing 18, which is preloaded with the electrical terminals 38, 38', is then moved by a suitable transfer mechanism 122 towards the cover support members 100, 102 until its rearward end 24 is substantially as shown in FIG. 14. The cover members are then moved arcuately in the direction of the arrows by the support members 100, 102 to the positions of FIG. 15 so that the cover members are assembled to the housing. During the final stages of the movement of the cover members into their assembled relationship, the signal wires **14*s* are pushed into the wire-receiving portions of the terminals 38' and the ground conductors 14*g* are pushed into the wire-receiving members of the commoning strap by the stuffer ribs 95, 95'** so that the electrical connections are obtained between the wires and the terminals and commoning strap.

It is important to note that the cover members are located on the surfaces of the supports 100, 102 with the folded hinge members 82, 82' against each other with the surfaces 104, 104' of the slots 81, 81' (FIG. 9) closely adjacent to each other. The cover members 20, 20' should be moved along the arcuate paths shown in FIG. 14 with respect to an axis 105 which extends along the rightwardly facing surface of the insulation of the cable and through the conductors 14 in the cable. By virtue of the location of this pivotal axis, there will be substantially no relative movement of the conductors 14 with respect to the cover members 20, 20' when the cover members are swung towards each other and into enclosing relationship to the connector housing and there will therefore be no slack portions of the conductors in the finished connector assembly.

Figure 16:
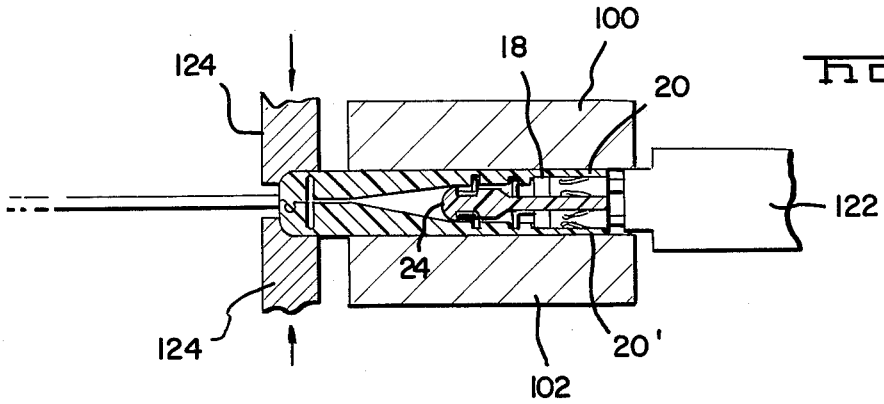

The final step of the assembly process is shown in FIG. 16; closing tools 124 move relatively towards each other to pivot the outer portions 84, 84' of the cover members into engagement with each other. The retaining rib means 90 of the cover member 84 is moved into the recess 90' of the cover member 84' to lock the parts in their assembled relationship.

Figure 17:
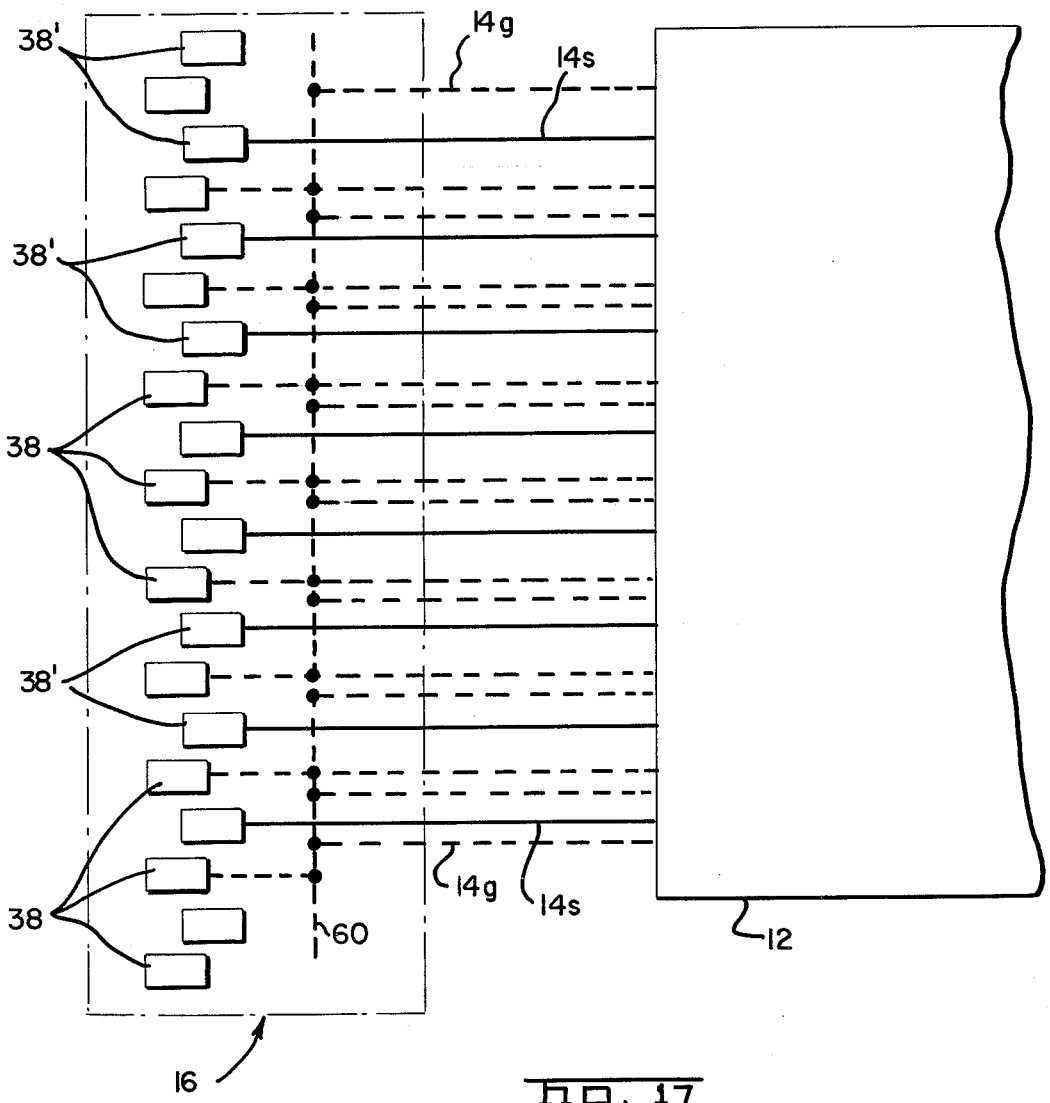
FIG. 17 is a schematic diagram showing the manner in which the signal and ground conductors of the cable shown in FIG. 2 are connected to the grounding member and the terminals of the connector shown in FIGS. 4–8.

The electrical connections of the ground conductors 14g and the signal conductors 14s to the terminals 38, 38' and the grounding strap 66 of the connector are shown schematically in FIG. 17. As previously mentioned, four of the terminals in the connector housing are not used in this cable termination and all of the eight signal conductors are connected to terminals on one side of the housing, the terminals on the side 26'. The ground conductors 14g are all connected to the grounding strap and selected ground conductors are also connected to eight of the terminals 38 on the side 26 of the housing. The cable termination pattern shown in FIG. 17 is but one of many possible termination arrangements which can be achieved with connectors in accordance with the invention.

Figure 18:
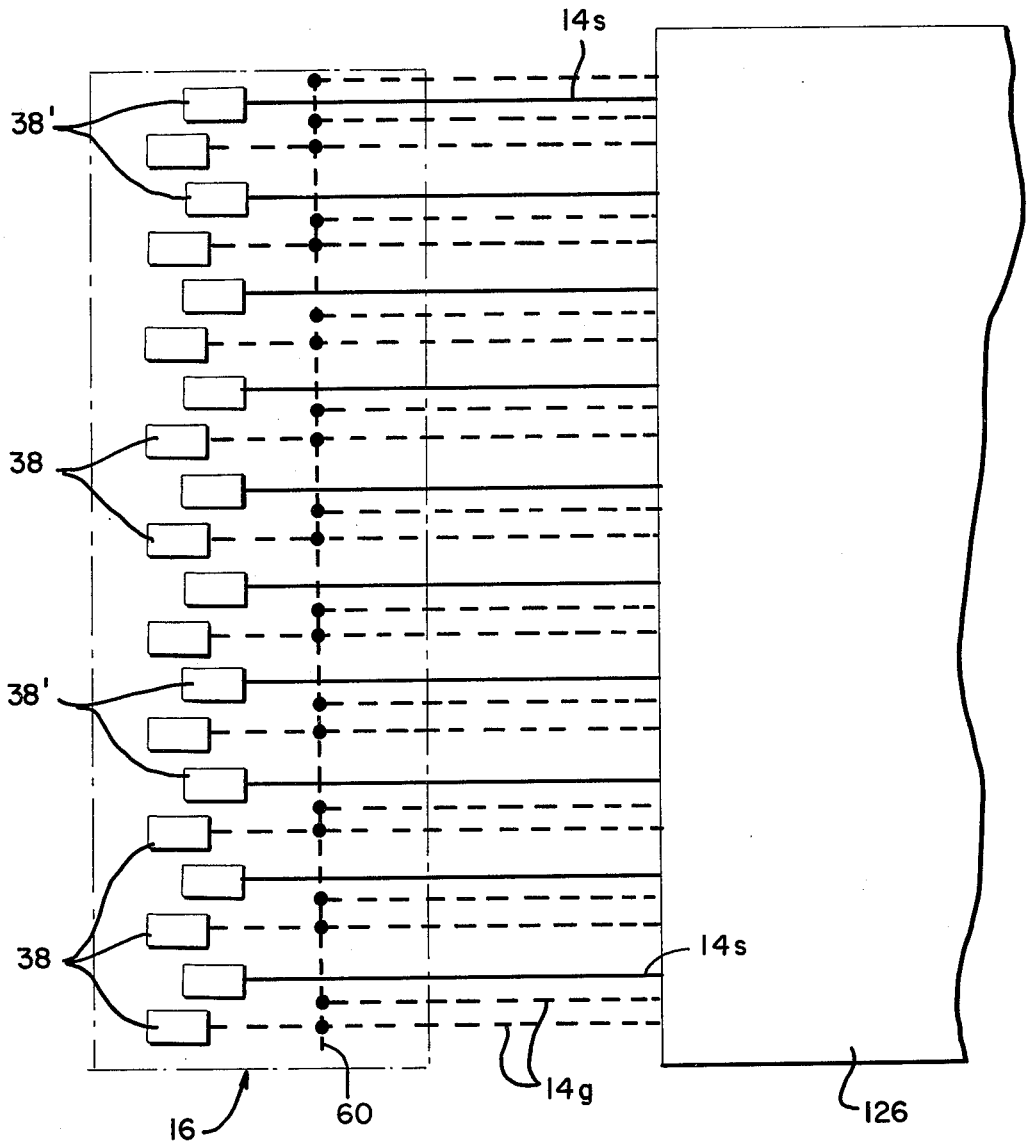
FIGS. 18 and 19 show schematically the manner in which other types of flat cables can be connected to the terminals and grounding strap of the connector.

FIG. 18 shows schematically a cable termination for a cable 126 which has ten signal conductors 14s and 21 ground conductors 14g. In accordance with this embodiment, the ten signal conductors are connected to the 10 terminals 38' on the side 26' of the housing and the ground conductors 14g are all connected to the grounding strap 60. Additionally, those ground conductors which are in alignment with the terminals 38 of the side 26 are connected to the terminals 38. It will be apparent that when it is desired to terminate a 31 conductor cable of the type shown in FIG. 18, the wire-receiving channels 94, 94' on the cover members 20, 20' must be sufficient in number for all of the conductors in the cable. It follows that while a single housing 18 can be used for a wide variety of cables and termination wiring patterns, different cover members are used for the different wiring patterns.

Figure 19:
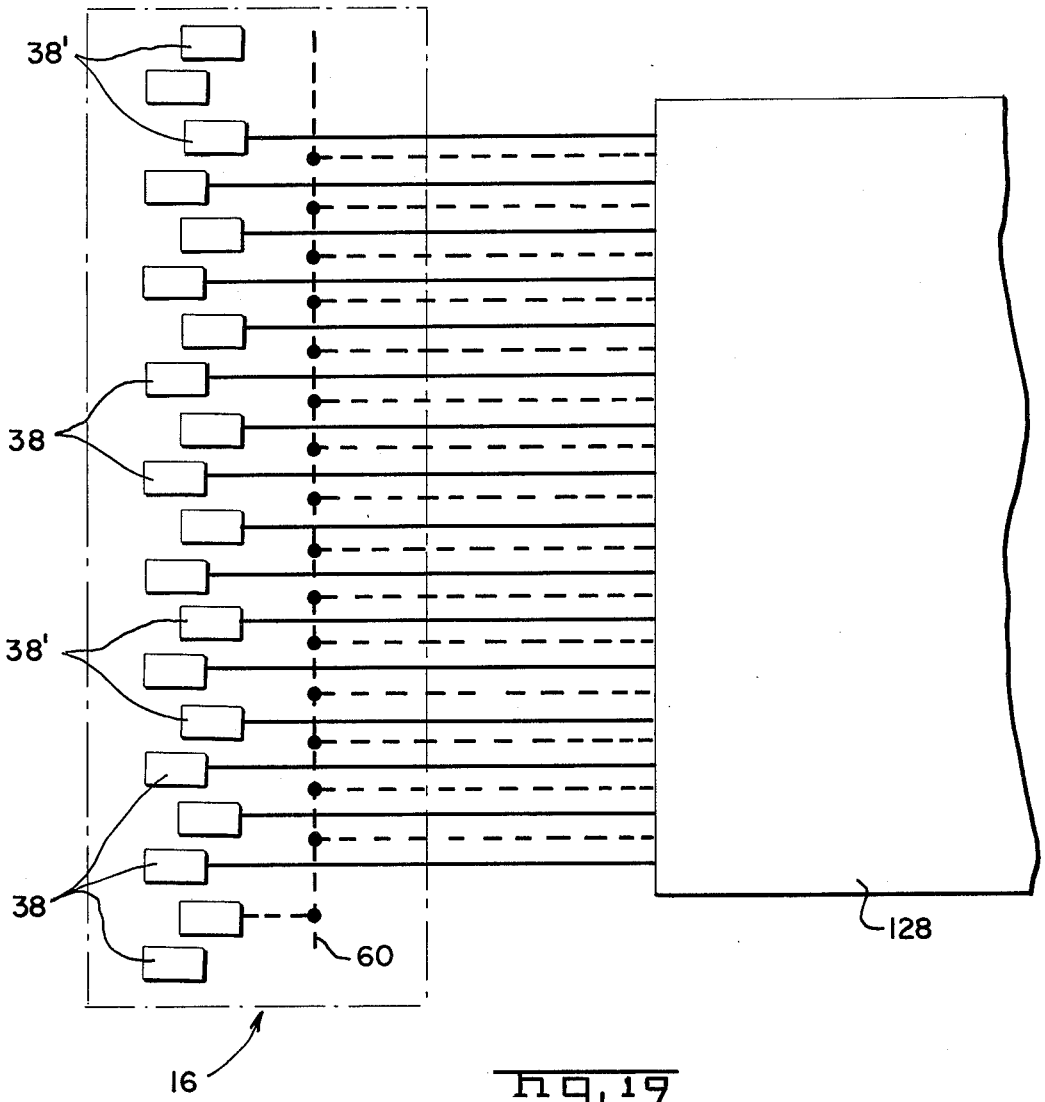

FIG. 19 shows another embodiment in which a connector in accordance with the invention is installed on the end of a cable 128 which has sixteen signal conductors and 15 ground conductors. The signal conductors are connected to selected terminals 38, 38' on both sides of the housing and the ground conductors are all connected to the commoning strap 60 with one of the ground conductors being also connected to one of the terminals 38'. In this embodiment, three of the terminals are not used. Again, the housing covers would be provided with appropriately designed wire-receiving channels 94, 94' so that the signal and ground conductors would be connected to the terminals for which they are intended when the covers are assembled to the housing.

FIG. 20 shows a connector housing 18 having an alternative form of commoning strap 130 thereon rather than the previously described commoning strap member 60. The use of the commoning strap 130 permits the installation of a connector on the ends of two cables 12, 12' as shown in the wiring diagram of FIG. 21, the cables 12, 12' being of the type described with reference to FIG. 2.

The commoning strap 130 has wire-receiving members extending from both, rather than one, of its edges as shown at 131, 132. The wire-receiving members in each row are offset from the wire-receiving members of the other row and as previously described, selected wire-receiving members are in alignment with the wire-receiving portions 42, 42' of the terminals 38, 38'.

As shown in the schematic wiring diagram of FIG. 21, the signal conductors 14s of the cable 12 are connected to the wire-receiving portions of eight of the ten terminals 38 on the side 30 of the housing. As previously explained, selected wire-receiving members are bent downwardly to their non-functional positions so that the electrical connections of the signal conductors to the terminals can be made without electrical contact between the signal conductors and the grounding strap. All of the ground conductors 14g of the cable 12 are connected to the grounding strap and the ground conductors on each side edge of the cable are additionally connected to the terminals 38 at the ends of the housing so that two terminals serve to connect the ground conductors to terminal posts on the panel board.

The connections between the signal and ground conductors of the cable 12' and the terminals 38' on the side 26' of the housing are identical to the connections between the cable 12 and the terminals 38. In other words, the same wiring plane is followed for both cables 12, 12'.

When the connector of FIG. 20 is installed on the ends of two cables, it will be apparent that each of the half grooves 92, 92' in the surfaces 80, 80' must accommodate two wires and since these wires are stripped of their insulation, it is desirable to take some precaution to avoid physical contact of the two wires with each other. The wires can be separated from each other by placing a length of suitable insulating tape over the surfaces 80, 80' of the cover members 20, 20' after the wires have been placed in the wire-receiving channels 94, 94' of the cover members. The grooves 92' should also be made relatively deep in this embodiment in order to provide sufficient clearance for the wires.

The schematic diagrams of FIGS. 17–19, and FIG. 21 are presented as representative examples of a wide variety of termination arrangements which can be achieved in the practice of the invention. It should also be noted that the principles of the invention can be employed to provide a single row connector rather than the two row connector shown and described. A single row connector, for example, may be provided to connect a number of conductors to an array of terminal pins which lie in a single row on the panel board. Such a connector, if it were made to be mated with ten terminal posts, would have the same length as the connector shown in the drawing but it would be only one-half as wide as the connector shown. The second cover member would serve the purpose of holding the wires in the cover in which the wire-receiving channels 94 would be provided.

What is claimed is:

1. A mutli-contact electrical connector which is intended for use with a multi-conductor cable of the type comprising a plurality of signal conductors and a plurality of ground conductors, said connector comprising:

a connector housing, said housing having a mating end, a rearward end, and a laterally facing side which extends between said mating end and said rearward end, a plurality of contact terminals in said housing, each of said terminals having a contact portion and a wire-receiving portion which receives a wire upon movement of said wire laterally of its axis towards said side and into said wire-receiving portion, said terminals being arranged in side-by-side relationship on said side of said housing in a row with said contact portions adjacent to said mating end and with said wire-receiving portions between said ends, a commoning conductor means on said laterally facing side extending across said side of said housing proximate to said rearward end, a plurality of ground conductor receiving members on said commoning conductor means, said ground conductor receiving members each having a functional position and a non-functional position, said ground conductor receiving members being effective to receive, and establish electrical contact with, a ground conductor when in said functional position and being spaced from a conductor extending across said surface when in said non-functional position, selected ground conductor receiving members being in alignment with said conductor-receiving portions of said contact terminals, and at least one ground conductor receiving member being located between each two adjacent contact terminals whereby, signal conductors in said cable can be connected to said contact terminals by placing said selected ground conductor-receiving members in said non-functional positions and moving said signal conductors laterally of their axis and into said conductor-receiving portions of said terminals, and said ground conductors can be commonly connected to said commoning conductor means by moving said ground conductors into said ground conductor receiving members, and said commoning conductor means can be electrically connected to one of said terminals by moving one of said ground conductors into one of said selected ground conductor receiving members and into the conductor receiving portion of the one terminal which is in alignment with said one selected ground conductor receiving member.

2. An electrical connector as set forth in claim 1, said commoning conductor means being of sheet metal, each of said ground conductor receiving members comprising a plate-like member which is integral with said commoning conductor means, each of said plate-like members having a free end and having a wire-receiving slot extending therein from said free end.

3. An electrical connector as set forth in claim 2, each of said contact terminals having a socket portion which constitutes said contact portion, and having a slotted plate wire-receiving member, which constitutes said wire-receiving portion.

4. A two row multi-contact electrical connector which is intended for use with a mutli-conductor cable of the type comprising a plurality of signal conductors and a plurality of ground conductors, said connector comprising:

a connector housing, said housing having a mating end, a rearward end, and laterally facing oppositely directed sides which extend between said mating end and said rearward end, a plurality of contact terminals in said housing, each of said terminals having a contact portion and a wire-receiving portion which receives a wire upon movement of said wire laterally of its axis towards said side and into said wire-receiving portion, said terminals being arranged in two parallel rows with one row on each of said sides, said terminals in each row being in side-by-side relationship on said sides of said housing with said contact portions adjacent to said mating end and with said wire-receiving portions between said ends, a commoning conductor means extending across said sides of said housing proximate to said rearward end, a plurality of ground conductor-receiving members on said commoning conductor means, said ground conductor-receiving members each having a functional position and a non-functional position, said ground conductor-receiving members being effective to receive, and establish electrical contact with, ground conductors when in said functional positions and being spaced from conductors extending across said surface when in said non-functional positions, selected ground conductor receiving members being in alignment with said condcutor-receiving portions of said contact terminals, and at least one ground conductor receiving member being located between each two adjacent contact terminals whereby, signal conductors in said cable can be connected to said contact terminals by placing said selected ground conductor-receiving members in said non-functional positions and moving said signal conductors laterally of their axis and into said conductor-receiving portions of said terminals, and said ground conductors can be commonly connected to said commoning conductor means by moving said ground conductors into said ground conductor receiving members, and said commoning conductor means can be electrically connected to one of said terminals by moving one of said ground conductors into one of said selected ground conductor receiving members and into the conductor receiving portion of the one terminal which is in alignment with said one selected ground conductor receiving member.

5. An electrical connector as set forth in claim 4, said commoning conductor means being of sheet metal, each of said ground conductor receiving members comprising a plate-like member which is integral with said commoning conductor means, each of said plate-like members having a free end and having a wire-receiving slot extending therein from said free end.

6. An electrical connector as set forth in claim 5, each of said contact terminals having a socket portion which constitutes said contact portion, and having a slotted wire-receiving member, which constitutes said wire-receiving portion.

7. An electrical connector as set forth in claim 4, said commoning conductor means comprising a sheet metal strap means extending across said laterally facing sides, said ground conductor receiving members comprising spaced-apart plate-like members extending from at least one edge of said strap means, each of said plate-like members having a wire-receiving slot extending therein from its free end.

8. A connector as set forth in claim 7, said plate-like members extending from both edges of said strap means.

9. An electrical connector as set forth in claim 5 in combination with cover means for said housing, said cover means comprising first and second cover parts, each of said parts having a wire positioning surface which is against one of said sides when said cover means is assembled to said housing, each of said wire positioning surfaces having wire holding recess means therein for holding said signal conductors and said ground conductors whereby, upon positioning said conductors in said wire holding recess means and thereafter assembling said cover means to said housing, said signal conductors and said ground condcutors are inserted into said wire-receiving portions of said contact terminals and into said ground conductor receiving members respectively.

10. A connector as set forth in claim 9, said first and second cover member parts each having rearward end portions which are proximate to said rearward end of said housing when said cover member parts are assembled to said housing, opening means in said rearward end portions for said cable, and strain relief means for said cable in said opening means.

11. A multi-contact electrical connector comprising:

a connector housing, said housing having a mating end, a rearward end, and laterally facing oppositely directed first and second sides which extend between said mating end and said rearward end, a plurality of contact terminals in said housing, each of said terminals having a contact portion and a wire-receiving portion which receives a wire upon movement of said wire laterally of its axis towards said side and into said wire-receiving portion, said terminals being arranged in two parallel rows with one row on each of said sides, said terminals in each row being in side-by-side relationship on said sides of said housing with said contact portions adjacent to said mating end and with said wire-receiving portions between said ends, cover means for said connector, said cover means comprising first and second cover parts which are intended for assembly to said housing against said first and second sides, said cover members having wire positioning and holding surfaces which are opposed to said first and second sides when said cover members are assembled to said housing, said cover members having leading ends and trailing ends, said leading ends being proximate to said mating end of said housing and said trailing ends being beyond said rearward end of said housing when said cover members are assembled to said housing, said wire positioning and holding surfaces extending between said leading and trailing ends, a plurality of wire holding means for gripping wires in interference relationship on said positioning and holding surfaces, each of said channels having a portion which is in alignment with said wire-receiving portions of one of said terminals when said cover members are assembled to said housing, and, interengaging means in said housing and said cover members for holding said cover members on said housing whereby, upon positioning wires in said wire holding channels and thereafter assembling said cover members to said housing, said wires are inserted into said wire-receiving portions of said terminals.

12. A connector as set forth in claim 11, said wire holding means comprising channels extending from said trailing ends of said cover members generally divergently towards said leading ends.

13. The method of installing a two row multi-contact connector on one end of a cable, said cable being of the type comprising a plurality of conductors in side-by-side spaced-apart co-planar relationship, said method comprising the steps of:

bending end portions of a first selected conductors in said cable in one direction from the plane of said cable and bending end portions of a second selected group of conductors in the opposite direction from the plane of said cable, locating said first and second groups of conductors in conductor receiving channels in first and second connector housing cover parts, and assembling said housing cover parts to said oppositely facing surfaces of said connector housings and thereby moving said conductors into said conductor-receiving portions of said terminals.

14. The method set forth in claim 13 wherein said step of locating said first and second groups of conductors in said channels is carried out by locating said cable between said first and second housing cover parts with said housing cover parts extending divergently from said cable and thereafter positioning said conductors in said channels, and wherein said step of assembling said housing cover parts to said housing is carried out by positioning said housing adjacent to said end of said cable and moving said cover parts arcuately towards said housing with respect to a common axis which extends through said cable so that there is no significant movement of said conductors relative to said cover parts.

15. An electrical connector for use in connecting a multiconductor flat cable having a predetermined distribution of ground and signal wires to an array of posts, said posts having a ground-signal distribution generally differing from that in said cable, said connector comprising:

template means, said template means being effective to progressively longitudinally deploy selected individual wires, having a ground-signal distribution equivalent to that of said posts, from said cable to first positions having a spacing equivalent to that of said posts, and being effective to deploy the remaining wires to second positions offset from said first positions, a connector housing, said housing having a first face, said housing being mateable with said template means with said first face adjacent to said template means, a plurality of terminals located on said connector housing, said terminals being spaced apart by a distance generally equal to the spacing of said posts, each of said terminals being effective to establish electrical contact with one of said posts, electrical contact means on each of said terminals for establishing electrical contact with one of said selected wires at said first positions when said housing is mated with said template means, ground commoning means located on said connector housing, and ground conductor contact means on said ground commoning means for establishing contact with said remaining wires at said second positions, whereby corresponding wires in said flat cable can be connected to corresponding posts.

16. An electrical connector as set forth in claim 15 wherein said template means comprises cover means.

17. An electrical connector as set forth in claim 16 wherein said plurality of terminals are in row configuration.

18. An electrical connector as set forth in claim 17 wherein said connector housing has an oppositely directed second face with a plurality of terminals located thereon.

19. An electrical connector as set forth in claim 18 wherein said template means comprises means for deaploying wires on opposite sides of said connector housing.

20. An electrical connector as set forth in claim 19 wherein said cover means comprises hinged over means with an opening for receiving said cable at the hinged segment thereof with template means on opposite sides of said hinged segment for deploying said wires.

21. An electric connector as set forth in claim 20 wherein said ground commoning means comprises a platelike member extending around said connector housing with ground conductor contact means on said first and said second faces.

22. An electrical connector as set forth in claim 15 wherein said template means comprises an elongate surface with a plurality of elongate channels extending thereacross for receiving said wires in interference fit therein.

23. An electrical connector for interconnecting a plurality of electrical conductors to a plurality of side-by-side electric circuit members, said electrical connector comprising:

first and second strain relief means for entrapping said conductors therebetween in side-by-side orientation intermediate the ends thereof, a generally planar housing member pivotally attached to each of said first and second strain relief means, wire holding template means, on the inner surface of each of said planar housing members, for deploying said electrical conductors, as said conductors are progressively pressed therein, from the immediate vicinity of said first and second means to mutually spaced-apart positions removed from the vicinity of said first and second means, a central housing member, a plurality of electrical terminals mounted in two side-by-side rows on said central housing member, one of said rows being adjacent to each of two oppositely facing sides of said central housing member, wire receiving means on each of said terminals for establishing electrical contact with one of said conductors upon movement thereof laterally of its axis thereinto, means for securing each of said planar housing members each to one of said two oppositely facing sides of said central housing member, said conductors being brought into contact with said wire receiving means at said mutually spaced-apart positions upon pivotal movement of said planar housing members, and contact means on each of said terminals for establishing electrical contact with said side-by-side electric circuit members.

24. An electrical connector as set forth in claim 23 wherein said planar housing members comprise cover members.

25. An electrical connector as set forth in claim 24 wherein said wire holding template means comprise a plurality of grooves for receiving said conductors in an interference fit therein as said wires are progressively pressed therein.

26. An electrical connector as set forth in claim 25 wherein said cover members are pivotal between an open position in which said cover members extend in opposite directions and are coplanar and a closed position in which said cover members are generally parallel.

27. An electrical connector for use in connecting a flat cable having a plurality of conductors spaced-apart by a distance on the order of 0.03 inches (0.12 cm) embedded in a common insulating web, and having a predetermined ground-signal distribution, to a plurality of square posts arrayed in two parallel rows, adjacent posts being spaced-apart by a distance generally on the order of 0.125 inches (0.318 cm), said posts having a ground-signal distribution differing from that in said cable, said connector comprising:

a central insulating housing having a mating end, a rearward end, and laterally facing oppositely directed sides spaced-apart by a distance less than the spacing of said adjacent posts, said sides extending from said mating end to said rearward end, a plurality of cavities extending inwardly from said mating end of said housing in two parallel rows, each row of cavities being adjacent one of said laterally facing oppositely directed sides, a plurality of contacting terminals mounted on said housing in said cavities, said terminals being in two parallel rows, one row on each of said oppositely directed sides, adjacent terminals in each row being spaced-apart by a distance equal to the spacing of said adjacent posts, contact means on each of said terminals for establishing electrical contact with one of said posts, wire receiving means on each of said terminals for establishing electrical contact with a wire upon movement laterally of its axis thereinto, a commoning conductor means mounted on said central insulating housing adjacent said rearward end, and extending across said sides, a plurality of ground conductor receiving members on said commoning conductor means for establishing electrical contact with a wire upon movement laterally of its axis thereinto, said ground conductor receiving members being selectively positioned generally perpendicular to said laterally facing sides, a pair of cover members, strain relief means for securing said cable at a first end of each of said cover members, template means for deploying the stripped ends of said conductors from the vicinity of said first end of said cover member to first and second positions on said cover members, selected conductors having a ground-signal distribution equivalent to that of said posts being deployed to said first positions, the remaining conductors being deployed to said second positions, and means for mating said cover members to said central housing members so that said first positions are aligned with said wire receiving means on said terminals and said second positions are aligned with said ground conductor receiving members.

28. A method of interconnecting an insulated multiconductor flat cable having a predetermined distribution of ground and signal wires to an array of posts, said posts having a ground-signal distribution generally differing from that in said cable, said method comprising the steps of:

removing the insulation from one end of said cable to expose free ends thereof, securing said cable adjacent a rearward end of a first insulating housing member, said first housing member having elongate channels extending from said rearward end along one surface thereof, progressively pressing said signal wires into a first group of said channels extending from said rearward end to first positions being spaced-apart by a distance equal to the spacing of adjacent signal posts, simultaneously progressively pressing said ground wires into a second group of said channels extending from said rearward end to second positions spaced from said first positions, attaching said signal wires to terminals at said first positions, and attaching said ground wires to a ground commoning strip at said second positions, whereby said terminals can then be attached to said posts to form the interconnection between said cable and said posts.

29. A method as set forth in claim 28 wherein said terminals are arrayed in row configuration on a second housing member, said signal wires being attached to said terminals by mating said first and second housing members.

30. A method as set forth in claim 29 wherein said ground commoning strip is located on said second housing member, said ground wires being attached to said ground commoning strip by mating said first and second housing members.

31. A method as set forth in claim 28 wherein said second positions are between said rearward end and said first positions.

32. A method as set forth in claim 31 wherein at least one channel of said second group extends beyond said second positions to said first positions, and said wire in said at least one channel is attached to said ground commoning strip at said second position and to a ground terminal at said first position.

33. A method of installing a two row multi-contact connector on one end of a cable, said cable being of the type comprising a plurality of conductors in side-by-side spaced-apart co-planar relationship, each conductor having a free end adjacent said one end, said method comprising the steps of:

positioning said cable with the free ends extending between first and second connector housing members, each housing member having template means on the inner surface thereof, securing an intermediate portion of said free ends between said first and second connector housing member each housing member having template means on the inner surface thereof, bending said free ends of a selected group of said conductors relative to the remaining group of said conductors toward said first housing member, inserting a conductor deploying member between the free ends of selected group and said remaining group of said conductors, moving said conductor deploying member across the inner surface of each of said first and second housing members to progressively insert said free ends of said selected group of said conductors into said template means in said first housing member and to progressively insert said free ends of said remaining group of said conductors into said template means in said second housing member, positioning a plurality of electrical terminals arrayed in two oppositely facing parallel rows between said first and second housing members, said terminals each having wire receiving means for establishing electrical contact with one of said conductors upon movement laterally of its axis thereinto, and relatively arcuately moving said first and second housing members towards each other thereby bringing said conductors into electrical contact with said terminals located therebetween.

34. A method as set forth in claim 33 wherein movement of said conductors into said template means comprises the step of progressively pressing said conductors into interference fit in a plurality of elongate conductor receiving channels on the inner surface of said first and second connector members.

* * * * *

UNITED STATES PATENT OFFICE

CERTIFICATE OF CORRECTION

Patent No. 4,094,566 Dated June 13, 1978

Inventor(s) Frank Peter Dola; and Frederick William Rossler, Jr.

It is certified that error appears in the above-identified patent and that said Letters Patent are hereby corrected as shown below:

Claim 19, column 14, line 63, "dea" should read - - - de - - -.

Claim 20, column 14, line 67, "over" should read - - - cover - - -.

Claim 21, column 15, line 3, the word "electric" should read - - - electrical - - -.

Claim 33, column 18, line 5, the word "member" should read - - - members - - -.

Signed and Sealed this

Twelfth Day of December 1978

[SEAL]

Attest:

RUTH C. MASON
Attesting Officer

DONALD W. BANNER
Commissioner of Patents and Trademarks